US008876562B2

(12) United States Patent
Glick et al.

(10) Patent No.: US 8,876,562 B2
(45) Date of Patent: Nov. 4, 2014

(54) FEMALE TYPE CONTACT FOR AN ELECTRICAL CONNECTOR

(75) Inventors: Michael Glick, Farmington Hills, MI (US); Slobadan Pavlovic, Novi, MI (US); Allen Leo Mott, Livonia, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/101,592

(22) Filed: May 5, 2011

(65) Prior Publication Data

US 2012/0282823 A1 Nov. 8, 2012

(51) Int. Cl.
*H01R 13/187* (2006.01)
*H01R 13/11* (2006.01)

(52) U.S. Cl.
CPC ..... *H01R 13/187* (2013.01); *H01R 13/111* (2013.01)
USPC ..... 439/843

(58) Field of Classification Search
USPC ..... 439/851, 842, 843, 748
See application file for complete search history.

(56) References Cited

U.S. PATENT DOCUMENTS

| | | | | |
|---|---|---|---|---|
| 2,912,668 | A | | 11/1959 | Eddy |
| 3,003,135 | A | | 10/1961 | Purinton |
| 3,161,451 | A | | 12/1964 | Neidecker |
| 3,564,487 | A | | 2/1971 | Upstone et al. |
| 3,784,965 | A | | 1/1974 | Murphy |
| 3,815,081 | A | | 6/1974 | Jones |
| 3,861,776 | A | | 1/1975 | Deal |
| 4,002,400 | A | * | 1/1977 | Evans ..... 439/748 |
| 4,359,258 | A | | 11/1982 | Palecek et al. |
| 4,401,359 | A | | 8/1983 | Frelk |
| 4,447,110 | A | | 5/1984 | Punako et al. |
| 4,461,530 | A | | 7/1984 | Brush, Sr. et al. |
| 4,508,413 | A | | 4/1985 | Bailey |
| 4,572,606 | A | | 2/1986 | Neumann et al. |
| 4,585,295 | A | | 4/1986 | Ackerman |
| 4,621,887 | A | | 11/1986 | Piscitelli et al. |
| 4,714,441 | A | | 12/1987 | Corman |
| 4,728,304 | A | | 3/1988 | Fischer |
| 4,734,063 | A | | 3/1988 | Koch et al. |
| 4,734,064 | A | | 3/1988 | Knapp et al. |

(Continued)

FOREIGN PATENT DOCUMENTS

| | | |
|---|---|---|
| CH | 151479 | 12/1931 |
| DE | 19836196 A1 | 2/1999 |

(Continued)

OTHER PUBLICATIONS

International Search Report, Application No. PCT/US2012/036518, filed May 4, 2012, Dated Aug. 6, 2012.

(Continued)

*Primary Examiner* — Neil Abrams
*Assistant Examiner* — Travis Chambers
(74) *Attorney, Agent, or Firm* — MacMillan, Sobanski & Todd, LLC

(57) ABSTRACT

A female type contact is provided for use with an electrical connector. The female type contact includes a body portion and a plurality of flexible beams that extend from the body portion. The flexible beams include a base portion having a first width and a tip portion having a second width that is smaller than the first width of the base portion.

20 Claims, 4 Drawing Sheets

(56) References Cited

U.S. PATENT DOCUMENTS

| | | | | |
|---|---|---|---|---|
| 4,780,097 | A | 10/1988 | Piscitelli | |
| 4,826,144 | A | 5/1989 | Balsells | |
| 4,934,967 | A | 6/1990 | Marks et al. | |
| 5,046,952 | A | 9/1991 | Cohen et al. | |
| 5,106,328 | A | 4/1992 | Prochaska et al. | |
| 5,139,276 | A | 8/1992 | Balsells | |
| 5,147,221 | A | 9/1992 | Cull et al. | |
| 5,203,813 | A | 4/1993 | Fitzsimmons et al. | |
| 5,358,224 | A | 10/1994 | Balsells | |
| 5,362,244 | A | 11/1994 | Hanson et al. | |
| 5,376,012 | A | 12/1994 | Clark | |
| 5,419,723 | A | 5/1995 | Villiers et al. | |
| 5,449,304 | A | 9/1995 | Huss, Jr. et al. | |
| 5,474,309 | A | 12/1995 | Balsells | |
| 5,474,479 | A | 12/1995 | Bennett et al. | |
| 5,482,476 | A | 1/1996 | Watanabe et al. | |
| 5,486,123 | A | 1/1996 | Miyazaki | |
| 5,509,814 | A | 4/1996 | Mosquera | |
| 5,588,852 | A | 12/1996 | Puerner | |
| 5,591,039 | A | 1/1997 | Matthews | |
| 5,599,027 | A | 2/1997 | Balsells | |
| 5,658,175 | A * | 8/1997 | Muzslay | 439/852 |
| 5,667,413 | A * | 9/1997 | Trafton | 439/843 |
| 5,676,571 | A | 10/1997 | Matthews | |
| 5,730,628 | A | 3/1998 | Hawkins | |
| 5,735,716 | A | 4/1998 | Bilezikjian | |
| 5,816,643 | A | 10/1998 | Itou et al. | |
| 5,897,404 | A | 4/1999 | Goodman et al. | |
| 5,921,803 | A | 7/1999 | Mori | |
| 5,938,487 | A | 8/1999 | Henry et al. | |
| 6,039,614 | A | 3/2000 | Ramari | |
| 6,042,432 | A | 3/2000 | Hashizawa et al. | |
| 6,062,919 | A | 5/2000 | Trafton | |
| 6,102,746 | A | 8/2000 | Nania et al. | |
| 6,102,751 | A | 8/2000 | Becker | |
| 6,186,841 | B1 | 2/2001 | Jacobsson | |
| 6,190,215 | B1 | 2/2001 | Pendleton et al. | |
| 6,250,974 | B1 * | 6/2001 | Kerek | 439/843 |
| 6,254,439 | B1 * | 7/2001 | Endo et al. | 439/843 |
| 6,264,508 | B1 | 7/2001 | Lehmann | |
| 6,273,766 | B1 | 8/2001 | Zennamo, Jr. et al. | |
| 6,296,970 | B1 | 10/2001 | Killebrew et al. | |
| 6,328,615 | B1 | 12/2001 | Safai | |
| 6,464,546 | B2 | 10/2002 | LaCoy | |
| 6,475,039 | B1 | 11/2002 | Despouys | |
| 6,482,049 | B1 * | 11/2002 | Swearingen | 439/843 |
| 6,590,478 | B2 | 7/2003 | Pluymers | |
| 6,752,668 | B2 | 6/2004 | Koch, Jr. | |
| 6,811,453 | B2 * | 11/2004 | Williams | 439/843 |
| 6,835,084 | B2 | 12/2004 | Poon et al. | |
| 6,837,756 | B2 | 1/2005 | Swearingen et al. | |
| 6,848,922 | B2 | 2/2005 | Coughlan et al. | |
| 6,899,571 | B1 * | 5/2005 | Koch et al. | 439/843 |
| 6,966,802 | B2 | 11/2005 | Hielscher et al. | |
| 6,969,220 | B2 | 11/2005 | Anquetin | |
| 7,048,596 | B2 | 5/2006 | Swearingen et al. | |
| 7,191,518 | B2 | 3/2007 | Beloritsky et al. | |
| 7,393,252 | B2 | 7/2008 | Ribeau et al. | |
| 7,828,609 | B2 | 11/2010 | Li et al. | |
| 7,845,992 | B2 | 12/2010 | Glick et al. | |
| 7,892,050 | B2 | 2/2011 | Pavlovic et al. | |
| 7,909,236 | B2 | 3/2011 | Erdie | |
| 8,282,429 | B2 | 10/2012 | Glick et al. | |
| 8,414,339 | B1 | 4/2013 | Glick et al. | |
| 8,425,253 | B2 | 4/2013 | Malloy et al. | |
| 8,430,698 | B2 | 4/2013 | Stewart et al. | |
| 2002/0055305 | A1 * | 5/2002 | Williams | 439/851 |
| 2002/0122690 | A1 | 9/2002 | Poon et al. | |
| 2003/0040228 | A1 | 2/2003 | Finzer et al. | |
| 2003/0077950 | A1 | 4/2003 | Swearingen et al. | |
| 2004/0245686 | A1 | 12/2004 | Balsells | |
| 2005/0242910 | A1 | 11/2005 | Balsells | |
| 2007/0190868 | A1 * | 8/2007 | De Cloet et al. | 439/851 |
| 2008/0246231 | A1 | 10/2008 | Sjostedt et al. | |
| 2008/0254670 | A1 | 10/2008 | Balsells et al. | |
| 2008/0255631 | A1 | 10/2008 | Sjostedt et al. | |
| 2009/0258519 | A1 | 10/2009 | Dilmaghanian et al. | |
| 2009/0298356 | A1 | 12/2009 | Li et al. | |
| 2010/0029127 | A1 | 2/2010 | Sjostedt | |
| 2010/0029145 | A1 | 2/2010 | Balsells et al. | |
| 2010/0279558 | A1 | 11/2010 | Leon et al. | |
| 2010/0311266 | A1 | 12/2010 | Dilmaghanian et al. | |
| 2011/0034053 | A1 | 2/2011 | Matsumoto et al. | |
| 2011/0171850 | A1 | 7/2011 | Brown, II | |
| 2012/0000329 | A1 | 1/2012 | Glick | |
| 2012/0003880 | A1 | 1/2012 | Glick et al. | |
| 2012/0003882 | A1 | 1/2012 | Stewart et al. | |
| 2012/0003883 | A1 | 1/2012 | Pavlovic et al. | |
| 2012/0282797 | A1 | 11/2012 | Mott et al. | |
| 2012/0282823 | A1 | 11/2012 | Glick et al. | |
| 2012/0322322 | A1 | 12/2012 | Stewart et al. | |
| 2013/0017739 | A1 | 1/2013 | Glick et al. | |
| 2013/0052854 | A1 | 2/2013 | Mott et al. | |
| 2013/0109221 | A1 | 5/2013 | Glick et al. | |
| 2013/0109237 | A1 | 5/2013 | Glick et al. | |
| 2013/0337702 | A1 | 12/2013 | Pavlovic et al. | |

FOREIGN PATENT DOCUMENTS

| | | | |
|---|---|---|---|
| DE | 19943373 | A1 | 3/2000 |
| DE | 102004002403 | B3 | 7/2005 |
| FR | 997233 | A | 1/1952 |
| JP | 2007317403 | A | 12/2007 |
| WO | 2010060370 | A1 | 6/2010 |

OTHER PUBLICATIONS

Written Opinion of the International Search Authority, Application No. PCT/US2012/036518, filed May 4, 2012, Dated Aug. 6, 2012.

"SAE Electric Vehicle and Plug in Hybrid Electric Vehicle Conductive Charge Coupler", Surface Vehicle Recommended Practice, J1772 Jan. 2010, SAE International, Issued Oct. 1996, Revised Jan. 2010.

International Search Report and Written Opinion for corresponding Application No. PCT/US2012/036559, mailed Aug. 6, 2012, 2 pages.

International Preliminary Report for corresponding Application No. PCT/US2012/036559, mailed Apr. 1, 2014, 6 pages.

* cited by examiner

FEMALE TYPE CONTACT FOR AN ELECTRICAL CONNECTOR

BACKGROUND OF THE INVENTION

This invention relates in general to a female type contact for an electrical connector that can be used, for example, to connect a battery in an electric vehicle to a source of electrical energy. In particular, this invention relates to an improved structure for such a female type contact for an electrical connector that provides for increased durability and current carrying capacity, while simplifying the production and assembly thereof.

Electric and hybrid electric vehicles are typically propelled by an electric motor that draws current from an on-board battery. In order to maintain a sufficient amount of electrical energy in the battery to operate the electric motor, it is usually desirable to connect the battery to a source of electrical energy and thereby replenish the amount of electrical energy stored therein. To facilitate this, it is known to provide respective electrical charging connectors on both the vehicle and the source of electrical energy. The electrical charging connectors cooperate with one another so that the source of electrical energy can be quickly and easily connected to and removed from the vehicle to facilitate the recharging of the battery for subsequent use by the electric motor.

In some instances, the electrical charging connectors provided on the vehicle and the source of electrical energy include respective male and female type contacts. Typically, the male type contact includes one or more protruding portions that are sized and shaped to be received within respective receptacle portions provided on the female type contact. A wide variety of these male and female type contacts are known in the art. Generally speaking, the female type contact includes a cylindrical body portion having a plurality of flexible beams that extend axially therefrom. The flexible beams are angled inwardly from the body portion so as to receive and frictionally engage an outer surface of the male type contact when inserted therein.

It is known that the current carrying capacity of the assembly of the male and female type contacts is related to both the electrical conductivity of the material used to form the contacts and the magnitude of the engagement force exerted therebetween. To establish good electrical conductivity, it is common to form electrical contacts from copper. However, the magnitude of the engagement force exerted by copper can be undesirably reduced as a result of increased temperatures (caused by heat generated by the flow of electricity therethrough) and fatigue (caused by repetitive flexing of the beams due to repeated use). Thus, it would be desirable to provide an improved structure for a female type contact for an electrical connector that provides for increased durability and current carrying capacity, yet which is relatively simple and inexpensive to manufacture.

SUMMARY OF THE INVENTION

This invention relates to an improved structure for a female type contact that is adapted for use with an electrical connector. The female type contact includes a body portion and a plurality of flexible beams that extend from the body portion. The flexible beams include a base portion having a first width and a tip portion having a second width that is smaller than the first width of the base portion.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
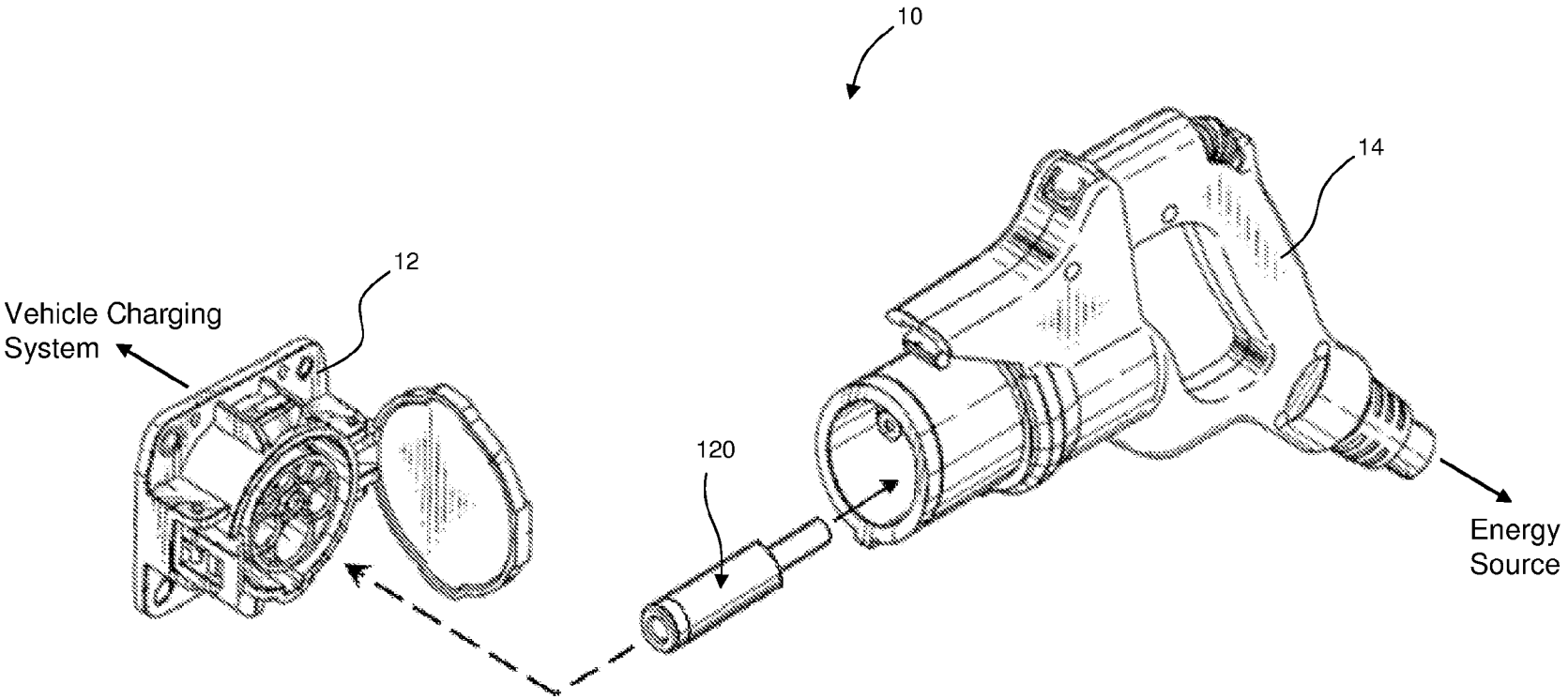
FIG. 1 is an exploded perspective view of portions of an electrical charging system that can be used, for example, to electrically connect a battery in an electric vehicle to a source of electrical energy for recharging.

Referring now to the drawings, there is illustrated in FIG. 1 portions of an electrical charging system, indicated generally at 10, in accordance with this invention. As will be explained in detail below, the electrical charging system 10 can be used, for example, to electrically connect a battery (not shown) in an electric vehicle to a source of electrical energy (not shown) for recharging. However, the illustrated electrical charging system 10 is intended merely to illustrate one environment in which this invention may be used. Thus, the scope of this invention is not intended to be limited for use with the specific structure for the electrical charging system 10 illustrated in FIG. 1 or with electrical charging systems in general. On the contrary, as will become apparent below, this invention may be used in any desired environment for the purposes described below.

The illustrated electrical charging system 10 includes a first portion 12 and a second portion 14. The first portion 12 of the electrical charging system 10 can, for example, be provided on a vehicle (not shown) and form a portion of a conventional charging system for a battery within the vehicle. The second portion 14 of the electrical charging system 10 can, for example, be provided on a source of electrical power (not shown) and form a portion of a conventional charging station for use with the charging system within the vehicle. In the illustrated embodiment, the first portion 12 of the electrical charging system 10 includes a male type electrical connector (not shown), while the second portion 14 of the electrical charging system 10 includes a female type electrical connector, indicated generally at 120. However, if desired, the first portion 12 of the electrical charging system 10 may alternatively include the female type electrical connector 120, while the second portion 14 of the electrical charging system 10 may include the male type electrical connector.

FIGS. 2 through 5 illustrate a first embodiment of the female type electrical connector 120 of this invention. As shown therein, the illustrated female type electrical connector 120 includes a housing, indicated generally at 130, that is generally hollow and cylindrical in shape. However, the housing 130 may have any desired shape. The housing 130 can be formed from any desired material, but preferably is formed from a material that is relatively rigid and electrically conductive. If desired, an outer layer of an electrically non-conductive material (not shown) may be provided about the housing 130. The illustrated housing 130 includes a first portion 130A and a second portion 130B, the purposes of which will be explained below. The first portion 130A and the second portion 130B can be integrally formed from a single piece of material as shown, but may alternatively be formed from two or more separate pieces material that are secured together. The illustrated first and second portions 130A and 130B of the housing 130 are co-axially aligned along a centerline CL, but may be non-aligned if desired.

The first portion 130A of the housing 130 is adapted to electrically connect the female type electrical connector 120 to the source of electrical energy. For example, the first portion 130A may define an aperture (not shown) that extends into an end portion thereof. The aperture can be adapted to receive a lead wire (not shown) that is connected the source of electrical energy. The lead wire may be secured within the aperture by a soldering, crimping, or other process. Alternatively, the first portion 130A of the female type electrical connector 120 can be connected to the source of electrical energy using a mechanical electrical connector or any other fastener arrangement if so desired. The first portion 130A may define any other structural features for a desired purpose.

The second portion 130B of the housing is configured to receive and frictionally engage the male type electrical connector. To accomplish this, the second portion 130B can be formed having a bore 132 that extends any length into an end portion thereof. Thus, the illustrated second portion 130B defines an open end where the bore 132 is provided and a closed end defined by a back wall 134. Further, it should be appreciated that the cylindrical wall of the second portion 130B may be any thickness for a desired application. The second portion 130B will be further described below.

The illustrated female type electrical connector 120 also includes a female type contact or electrical terminal, indicated generally at 140, that is disposed within the bore 132. The female type contact 140 is a hollow, cylindrical structure that includes a body portion 142 and having a plurality of flexible beams 144 extending therefrom. As shown, an outer cylindrical surface of the body portion 142 is adapted to frictionally engage an inner cylindrical wall of the bore 132 of the second portion 130B. Engagement between the body portion 142 and the second portion 130B secures the female type contact 140 within the bore 132 and establishes electrical continuity between the female type contact 140 and the housing 130. Insertion of the female type contact 140 within the second portion 130B will be further explained below. Alternative ways of securing the female type contact 140 within the second portion 130B will also be described and illustrated below.

The illustrated female type electrical connector 120 also includes an optional end piece 150. The end piece 150 can be secured to the open end of the second portion 130B. The illustrated end piece 150 has a through hole 152 formed therethrough. The end piece 150 can be formed from any desired material, but preferably is formed from an electrically non-conductive material such as plastic or the like. The purpose of the end piece 150 will be described in further detail below.

Figure 3:
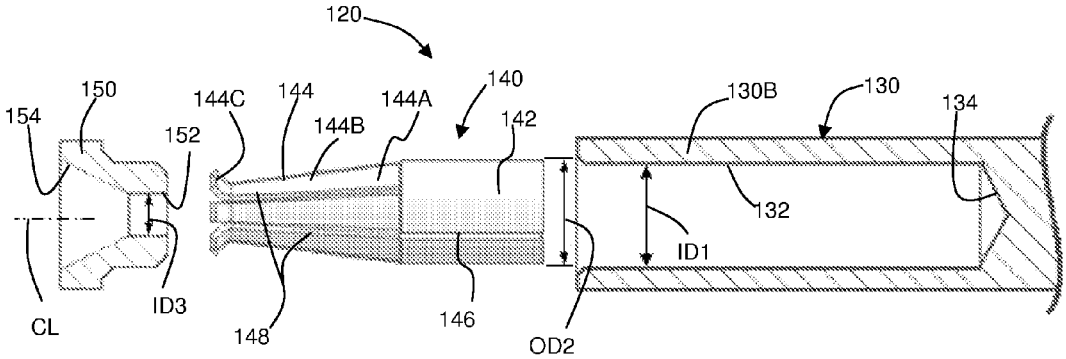
FIG. 3 is an exploded side elevational view, partially in cross section, of the electrical connector illustrated in FIG. 2.

FIG. 3 shows the components of the female type electrical connector 120 prior to assembly. As described above, the bore 132 is formed in the second portion 130B of the housing 130 so as to define an open end. If desired, a chamfer can be provided around the outer edge of the open end, although such is not required. The back wall 134 can be a generally flat surface or may define a conical shape that is formed by a cutting tool (not shown) used to machine the bore 132. The bore 132 has an inner diameter ID1 that is configured to receive the female type contact 140 in the manner explained below. It should be appreciated that the bore 132 can be any size and/or shape for a desired application.

The illustrated female type contact 140 can be produced from a sheet of resiliently flexible material that is cut and subsequently shaped to form the cylindrical body portion 142 and the flexible beams 144, as will be further explained below. In doing so, opposite edges of the sheet are brought together in an opposing fashion to form a gap 146. The gap 146 axially extends along an entire length of the body portion 142, although such is not required. The circumferential width of the gap 142 can be selectively adjusted by flexing a cross section of the body portion 142 from a relaxed or biased position to a flexed position. As such, the body portion 142 can be adjustable to provide a desired outer diameter OD2 of the body portion 142. The relaxed outer diameter OD2 of the body portion 142 is slightly larger than the inner diameter ID1 of the bore 132 prior to the female type contact 140 being inserted into the bore 132. The gap 146 enables the outer diameter OD2 of the body portion 142 to be temporarily reduced to facilitate the insertion of the female type contact 140 into the bore 132, as will be explained below.

The illustrated flexible beams 144 axially extend from the body portion 142 along the centerline CL and are angled inwardly relative to the body portion 142. Axially extending spaces 148 are defined between adjacent ones of the plurality of flexible beams 144. In the illustrated embodiment, the flexible beams 144 are integrally formed with the body portion 142. However, the flexible beams 144 can be separate members that are attached to the body portion 142 in any manner if desired.

Figure 4:
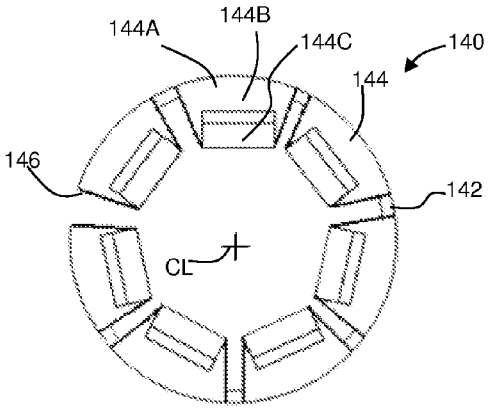
FIG. 4 is an end elevational view of a portion of a female type contact for the electrical connector illustrated in FIGS. 2 and 3.

As best shown in FIGS. 3 and 4, each of the illustrated flexible beams 144 includes a base portion 144A, an intermediate portion 144B, and a tip portion 144C. The base portion 144A extends from the body portion 142 and can define a curvature along its width that generally corresponds with the cylindrical shape of the body portion 142. The intermediate portion 144B extends between the base portion 144A and the tip portion 144C. In the illustrated embodiment, the intermediate portion 144B tapers from a larger circumferential width near the base portion 144A to a smaller circumferential width near the tip portion 144C, the purpose of which will be explained below. As a result, each of the illustrated axially extending spaces 148 that are defined between adjacent ones of the respective flexible beams 144 has a constant circumferential width along the axial lengths thereof. The tip portion 144C extends from the intermediate portion 144B. The tip portion 144C may define an angular relationship relative to the intermediate portion 144B so as to extend outwardly away from the centerline CL. The tip portion 144C will be further described below.

As mentioned above, the illustrated end piece 150 defines a through hole 152 that is adapted to receive a male type electrical connector having a desired outer diameter for insertion into the female type electrical connector 120. Thus, the through hole 152 may define a predetermined inner diameter ID3. It will be appreciated that the inner diameter ID3 of the through hole 152 can be any size or shape for a desired application. The illustrated end piece 150 also includes a tapered inner diameter 154, although such is not required. The tapered diameter 154 is configured to properly align the male type electrical connector with the female type electrical connector 120 prior to being inserted therein. The illustrated tapered diameter 154 axially extends from an open extremity of the end piece 150 to the inner diameter ID3 of the through hole 152. The tapered diameter 154 may define any angular relationship relative to the through hole 152 and can extend any axial length into the end piece 150 for a desired application.

The assembly of the female type electrical connector 120 will now be described. As described above, the body portion 142 of the female type contact 140 has a relaxed outer diameter OD2 that is slightly larger than the inner diameter ID1 of the bore 132. As described above, the outer diameter OD2 of the body portion 142 can be temporarily reduced by deflecting the body portion 142 so as to reduce the circumferential width of the gap 146 that is defined between the opposing edges thereof. The gap 146 can initially define a circumferential width that allows the body portion 142 to deflect a sufficient amount for insertion into the bore 132 without exceeding the elastic limits of the selected material, which would otherwise cause permanent deformation. Once the female type contact 140 has been received within the housing 130, the resiliency of the material causes the body portion 142 to spring back or otherwise expand. As a result, the outer surface of the body portion 142 is biased for frictional engagement with the inner surface of the bore 132. The resultant engagement secures the female type contact 140 within the housing 130 and provides electrical continuity therebetween. The female type contact 140 may also be secured within the housing 130 by adhesives, welding, or any desired mechanism. Alternative embodiments for securing the female type contact 140 within the housing 130 and establishing electrical continuity therebetween will be described and illustrated below.

Subsequently, the end piece 150 can be secured to the open end of the housing 130. For example, the end piece 150 may define an outer portion that is configured to frictionally engage the inner diameter ID1 of the bore 132 to form a press-fit connection. Alternatively, the end piece 150 can be secured to the open end of the housing 130 by a threaded connection, an adhesive, or any other manner.

As best shown in FIGS. 3 and 4, in a relaxed position the flexible beams 144 radially extend inwardly from the body portion 142 toward the centerline CL. Conversely, the tip portions 144C extend outwardly away from the centerline CL. As a result, the tip portions 144C form an expandable eyelet having a crown or tulip arrangement that is configured to receive and frictionally engage an outer surface of the male type electrical connector (not shown), although such an arrangement is not required. The illustrated tip portions 144C define generally flat or planar surfaces across their width, although the tip portions 144C may define curved surfaces that correspond with the outer diameter of the male type electrical connector or any other surface contour if so desired.

The inner surfaces of the tip portions 144C combine to form an inner diameter that is slightly smaller than the outer diameter of the desired male type electrical connector. As the male type electrical connector is inserted into the female type electrical connector 120, the male type electrical connector initially engages the tip portions 144C. As a result, the flexible beams 144 are pivoted radially outwardly away from the centerline CL. The amount of force required to fully insert the male type electrical connector within the female type electrical connector 120, referred to as the insertion force, can be adjusted by varying the angular relationship of the tips 144C relative to the centerline CL. For example, a larger angular relationship defined between the tip portions 144C and the centerline CL results in a higher insertion force.

A normal force is applied to each of the respective flexible beams 144 by the male type electrical connector when it is received within the female type electrical connector 120. The normal force acts on each respective flexible beam 144 in a radial direction away from the centerline CL. Thus, it should be apparent that the normal force is equal to an amount of spring force that the respective flexible beam 144 exerts on the outer surface of the male type electrical connector.

It is generally known that an increase in spring force may increase the current carrying capacity of the female type electrical connector 120. The spring force of each respective flexible beam 144 can be determined by the selection of material used to form the female type contact 140 and/or by adjusting the dimensions (i.e. length, width, thickness, etc.) of the flexible beams 144. However, the size of the female type electrical connector 120 is generally limited. As such, simply increasing the dimensions of the flexible beams 144 to increase the spring force is not a practical option. It should become apparent that the illustrated flexible beams 144 can provide for increased current carrying capacity and improved durability of the female type electrical connector 120.

For example, the tapered width of each respective flexible beam 144 can distribute the bending stresses more evenly along the length of the beam which, in turn, can reduce the stresses that are typically concentrated at the base portion 144A thereof. A reduction in concentrated stresses at the base portion 144A may result in reduced fatigue and, therefore, a lower failure rate due to repetitive bending. As such, the female type contact 140 may be formed from a material having higher conductive properties if so desired, such as copper for example.

In addition, a reduction in concentrated stresses at the base portion 144A may also enable the female type contact 140 to be formed from a thinner sheet of material. A thinner sheet of material can allow for an increased number of flexible beams 144 to be used in the female type electrical connector 120 of relatively limited size. For example, the illustrated female type contact 140 includes seven flexible beams 144 that are equally spaced apart from one another. However, in other non-illustrated embodiments, the female type contact 140 can include any number of flexible beams 144 capable of being incorporated as described herein, such as ten or eleven beams if so desired. An increased number of flexible beams 144 results in an increased number of contact points which, in turn, can provide increased current carrying capacity for a female type electrical connector 120 of relatively limited size. As such, the female type contact 140 may be formed from a material having lower conductive properties with increased strength if so desired, such as a copper clad alloy for example. It should be appreciated that the female type contact 140 can be optimized by balancing the spring force and the number of the flexible beams 144 in relation to the current carrying capacity requirements for a particular application.

Figure 2:
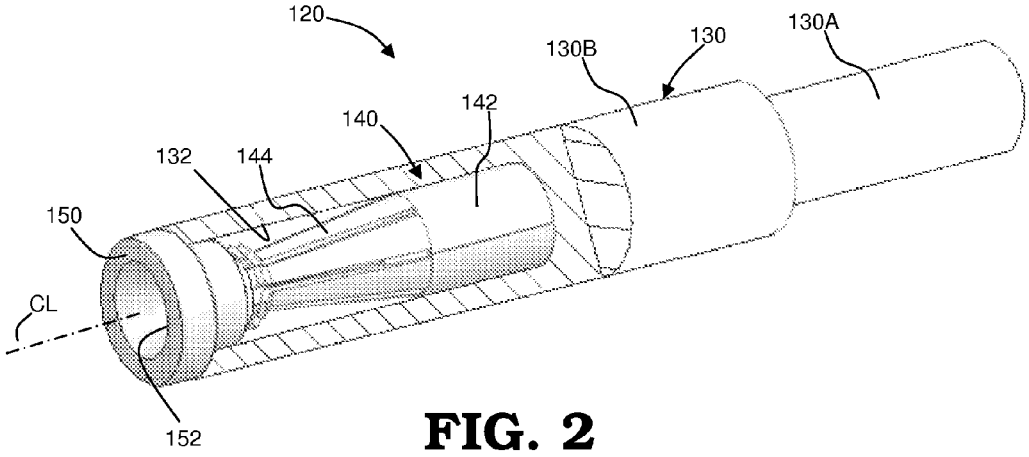
FIG. 2 is a perspective view, partially in cross section, of a first embodiment of an electrical connector for the electrical charging system illustrated in FIG. 1.
Figure 5:
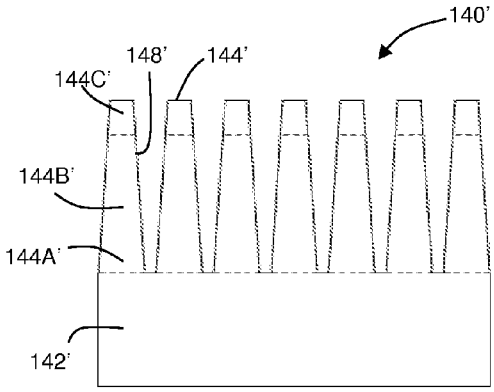
FIG. 5 is a top plan view of a sheet of material that can be used to form the female type contact illustrated in FIGS. 2, 3, and 4.
Figure 6:
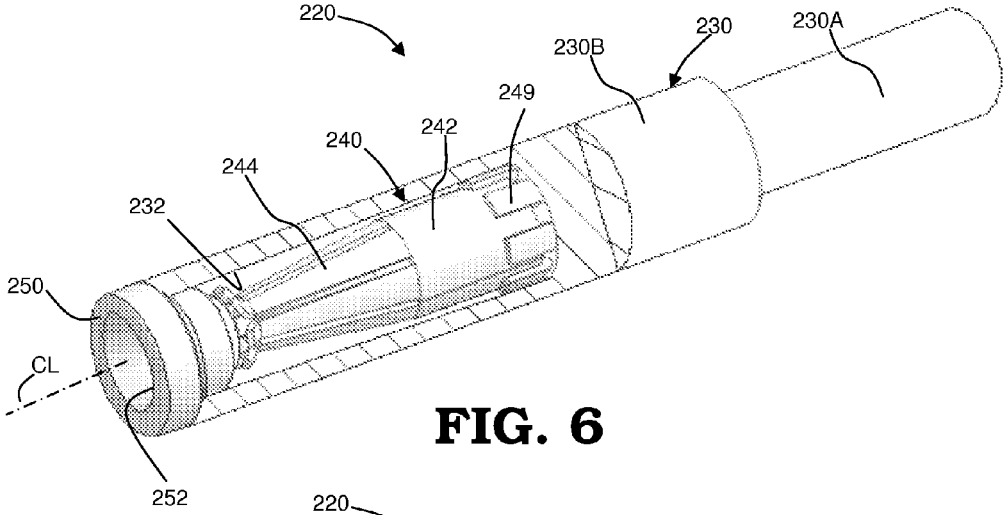
FIG. 6 is a perspective view, partially in cross section, of a second embodiment of an electrical connector for the electrical charging system illustrated in FIG. 1.
Figure 7:
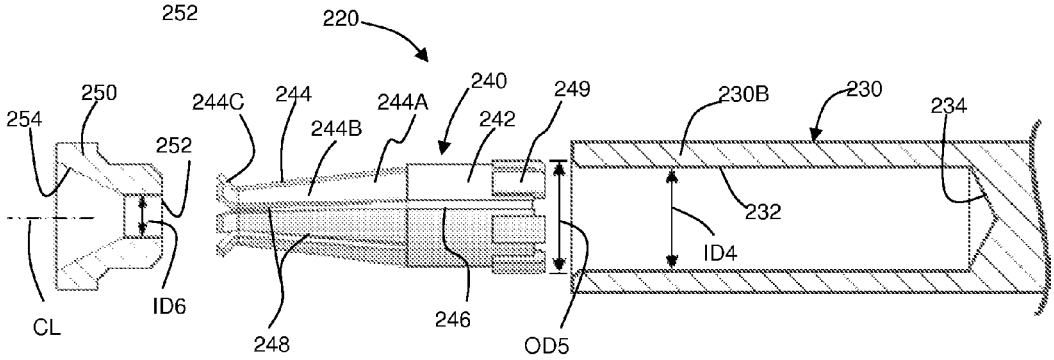
FIG. 7 is an exploded side elevational view, partially in cross section, of the electrical connector illustrated in FIG. 6.
Figure 8:
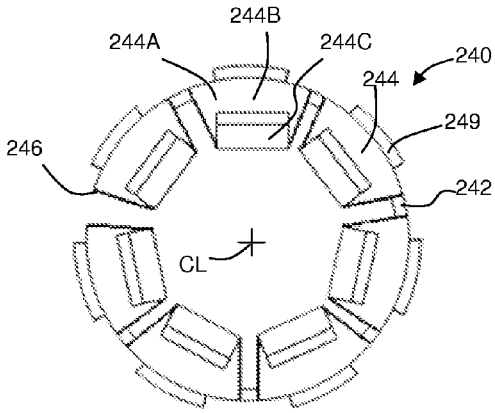
FIG. 8 is an end elevational view of a portion of a female type contact for the electrical connector illustrated in FIGS. 6 and 7.
Figure 9:
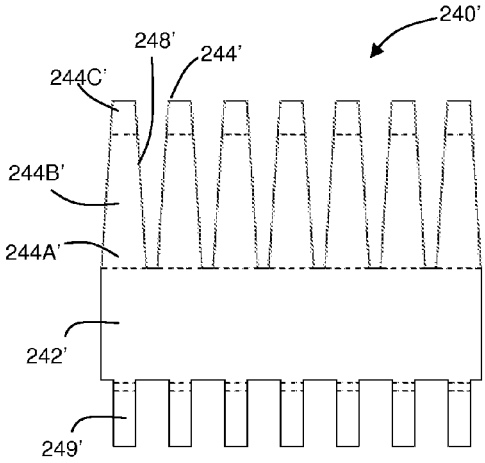
FIG. 9 is a top plan view of a sheet of material that can be used to form the female type contact illustrated in FIGS. 6, 7, and 8.
Figure 10:
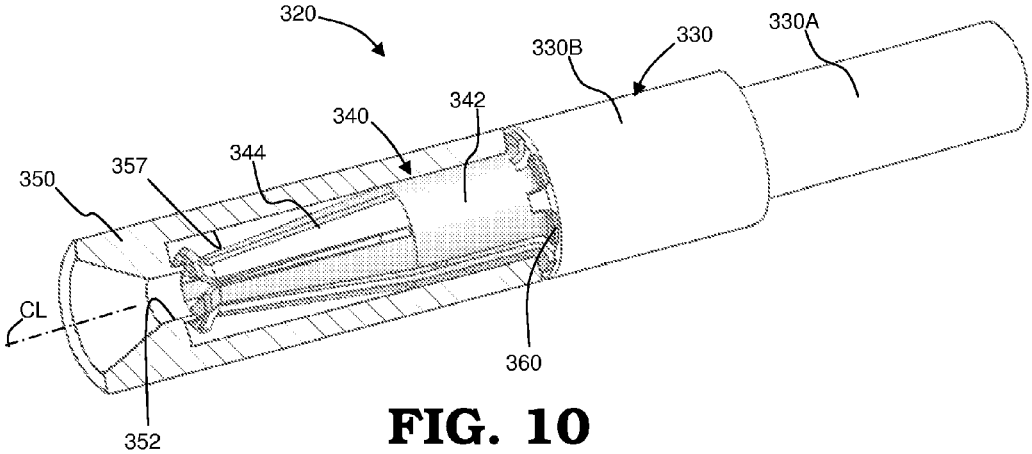
FIG. 10 is a perspective view, partially in cross section, of a third embodiment of an electrical connector for the electrical charging system illustrated in FIG. 1.
Figure 11:
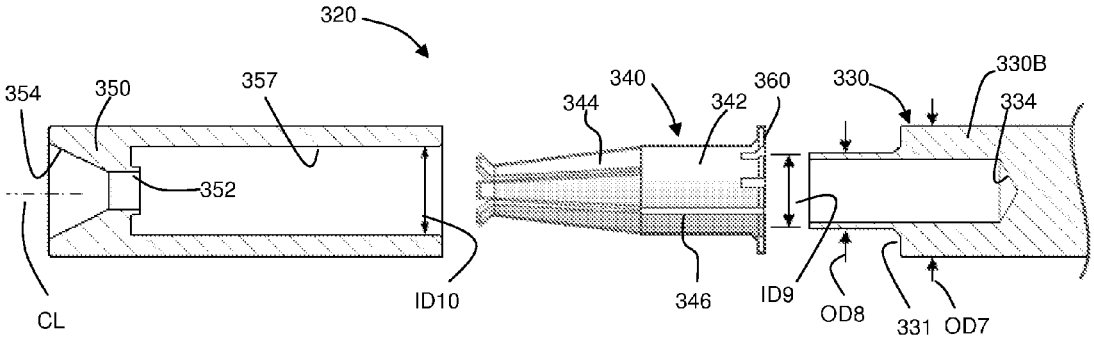
FIG. 11 is an exploded side elevational view, partially in cross section, of the electrical connector illustrated in FIG. 10.
Figure 12:
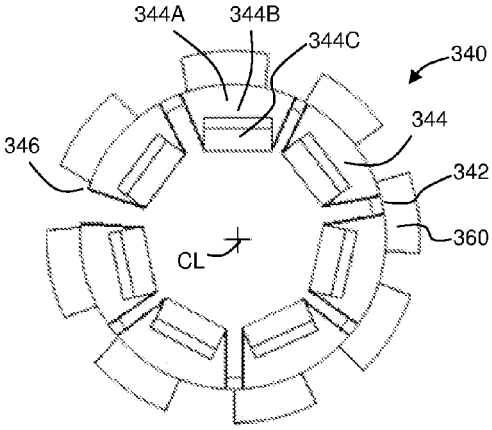
FIG. 12 is an end elevational view of a portion of a female type contact for the electrical connector illustrated in FIGS. 10 and 11.
Figure 13:
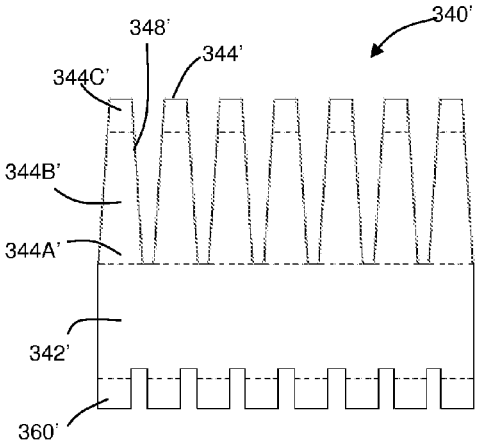
FIG. 13 is a top plan view of a sheet of material that can be used to form the female type contact illustrated in FIGS. 10, 11, and 12.

Referring now to FIG. 5, there is illustrated a sheet of material 140' that can be used to form the female type contact 140. The sheet 140' can be any resilient material that is electrically conductive, such as for example copper or a copper clad alloy. The sheet 140' may be stamped or otherwise cut to define an outline of the female type contact 140, as shown in FIGS. 2 through 4. The stamped sheet 140' may then be shaped to define the illustrated female type contact 140. For example, the sheet 140' can be shaped using a roll forming, bending, or any other suitable process. In particular, opposite edges of the sheet 140' are brought together in an opposing manner to form a cylindrical member. It should be appreciated that the sheet 140' may be any thickness for a desired application. Further, the sheet 140' may have a constant thickness throughout or, alternatively, can have a varying thickness to achieve desired spring forces in the body portion 142 and/or the flexible beams 144.

As shown, the sheet 140' may include a base portion 142' for forming a cylindrical cross section. It should be appreciated that the base portion 142' may include any apertures, tabs, or other features for a desired application. A plurality of beams 144' extend from the rectangular portion 142'. Each of the beams 144' has a base portion 144A' and a tip portion 144C' with an intermediate portion 144B' extending therebetween. The base portion 144A' has a larger width than the tip portion 144C' such that the width of the intermediate portion 144B' is tapered. The plurality of beams 144' are separated by spaces 148' that are defined between each of the beams 144'. The tip portions 144C' of the beams 144' may be bent or otherwise curved along the illustrated dashed line. The beams 144' are individually bent or otherwise curved along the illustrated dashed line that is positioned at the base portions 144A' thereof. It should be appreciated that indentation lines or the like may be provided along the illustrated dashed lines to control the location and accuracy of the bends and to assist in forming the female type contact 140.

FIGS. 6 through 9 illustrate a second embodiment of a female type electrical connector, indicated generally at 220, in accordance with this invention. The illustrated female type electrical connector 220 includes a housing 230, a female type contact 240, and an end piece 250. The housing 230 and the end piece 250 may be embodied as the housing 130 and the end piece 150 described above in the first embodiment. It should be appreciated, however, that the housing 230 and the end piece 250 need not be identical to those described above in the first embodiment but can be otherwise adapted for a desired application or purpose.

The illustrated female type contact 240 includes a body portion 242 and a plurality of flexible beams 244 extending therefrom. The body portion 242 and the flexible beams 244 can be similarly embodied as the body portion 142 and the flexible beams 144 described above in the first embodiment. However, in the illustrated embodiment the female type contact 240 further includes a plurality of tabs 249 that are positioned along an outer surface of the body portion 242. The tabs 249 may be integrally formed with the female type contact 240 from a sheet of material. The tabs 249 are subsequently folded so as to extend along and engage the outer surface of the body portion 242.

One purpose of the tabs 249 is to secure the female type contact 240 within the housing 230, as will be explained below. As such, the tabs 249 are configured to frictionally engage the inner surfaces of the housing 230 when the female type contact 240 is inserted therein. The tabs 249 can provide increased contact stresses with the inner surface of the housing 230 as compared to the first embodiment. As a result of the increased contact stresses, the tabs 249 may also provide for improved electrical continuity between the female type contact 240 and the housing 230. It should be appreciated that the female type contact 240 may include any number or configuration of tabs 249 for a desired application.

Insertion of the female type contact 240 into the housing 230 will now be explained. As shown, the tabs 249 of the body portion 242 initially define an outer diameter OD5 that is slightly larger than an inner diameter ID4 of the housing 230. Thus, the outer diameter OD5 defined by the tabs 249 can be temporarily reduced by deflecting the body portion 242 and minimizing or otherwise closing a gap 246 that extends along the body portion 242. Once the female type contact 240 has been received within the housing 230, the resiliency of the selected material causes the body portion 242 to spring back or otherwise expand. As a result, the outer surfaces of the tabs 249 are biased for frictional engagement with the inner surface of the housing 230. The resultant engagement secures the female type contact 240 within the housing 230 and provides electrical continuity therebetween. The female type contact 240 may also be secured within the housing 230 by an adhesive, a welding process, or any combination of the above.

Referring now to FIGS. 10 through 13, there is illustrated a third embodiment of a female type electrical connector, indicated generally at 320, in accordance with this invention. The illustrated female type electrical connector 320 includes a housing 330, a female type contact 340, and an end-piece 350. It should be appreciated that the female type electrical connector 320 may include any features as described above in the first and second embodiments or may be otherwise adapted for a desired application.

The illustrated housing 330 includes a first portion 330A and a second portion 330B. The first portion 330A and the second portion 330B can be similarly embodied as the first portion 330A and the second portion 130B described above in the first embodiment. However, the first portion 330A defines a first outer diameter OD7 and a second outer diameter OD8. The second outer diameter OD8 is smaller than the first outer diameter OD7 thereby forming a shoulder 331. The purposes of the second outer diameter OD8 and the shoulder 331 will be explained below.

The illustrated female type contact 340 includes a body portion 342 and a plurality of flexible beams 344 that extend therefrom. The body portion 342 and the flexible beams 344 can be similarly embodied as the body portion 142 and flexible beams 144 described above in the first embodiment. For example, the body portion 342 can define a generally hollow, cylindrical member having a gap 346 defined between two opposing edges thereof. Accordingly, the body portion 342 defines an inner diameter ID9. The inner diameter ID9 is slightly smaller than the second outer diameter OD8 of the housing 330, the purpose of which will be explained below.

In the illustrated embodiment, however, the female type contact 340 further includes a plurality of support legs 360 that are spaced apart from one another and extend outwardly from an edge of the body portion 342. The support legs 360 may extend outwardly any distance from the body portion 342. Further, the female type contact 340 can include any number or configuration of support legs 360 for a desired application. It should be appreciated that the support legs 360 can be integrally formed with the female type contact 340 from a sheet of material and subsequently formed as described above in the first and second embodiments.

As shown, the end piece 350 includes a through hole 352 and a tapered diameter 354 as described above in the first embodiment. However, the illustrated end piece 350 alternatively includes an elongated cylindrical portion that defines a bore 357 extending therethrough. The bore 357 has an inner diameter ID10, the purposes of which will be explained below. An inner edge of the bore 357 that is located at an open end of the end piece 350 may be chamfered or otherwise rounded, although such is not required. It should be appreciated that the end piece 350 can be any length or have any thickness cylindrical wall for a desired application.

Assembly of the female type electrical connector 320 will now be described. Initially, the body portion 342 of the female type contact 340 is placed over the second outer diameter OD8 of the housing 330. As briefly described above, the body portion 342 of the female type contact 340 initially defines an inner diameter ID9 that is slightly smaller than the second outer diameter OD8 of the housing 330. Thus, the inner diameter ID9 of the body portion 332 can be temporarily expanded by deflecting the body portion 342 and increasing the gap 346 that is located between the opposing edges. This can by accomplished engaging the inner diameter ID9 of the body portion 342 with the second outer diameter OD8 of the housing 330. Once the female type contact 340 has been positioned over the second outer diameter OD8 of the housing 130, the resiliency of the selected material causes the body portion 342 to spring back or otherwise contract. As a result, the inner surface of the body portion 342 frictionally engages the second outer diameter OD8 of the housing 330. The resultant engagement secures the female type contact 340 to the housing 330 and establishes electrical continuity between the mating components. The female type contact 340 may also secured to the housing 330 by an adhesive, a welding process, or any combination of the above.

Subsequently, the end piece 350 can be secured over the female type contact 340. For example, the inner diameter ID10 of the bore 357 defined by the end piece 350 may be configured to frictionally engage an outer surface of the body portion 342 of the female type contact 340 to form a press-fit connection. In this embodiment, the support legs 360 of the female type contact 340 are secured between the housing 330 and the end piece 350. Alternatively, the end piece 350 can be secured to the female type contact 340 or to the housing 330 by a threaded connection, and adhesive, or any other method.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical connector comprising:

a housing that defines a bore having an inner surface;

a contact with a body portion; and a plurality of flexible beams that extend from the body portion;

wherein the body portion defines a cross section that is adjustable between a relaxed position and a flexed position, when the contact is in the relaxed position the contact has a relaxed outer diameter that is larger than an inner diameter of the bore, when the contact is in the flexed position the contact has an outer diameter that is smaller than the inner diameter of the bore, and the contact is disposed within the bore; and wherein either:

(a) a base portion of the flexible beams defines a curvature along a first width and a tip portion of the flexible beams defines a flat surface along a second width;

(b) the contact further includes a plurality of support legs that extend outwardly from the body portion; or (c) the housing is made of an electrically conductive material, the flexible beams extend inwardly toward one another such that spaces defined between adjacent flexible beams have a constant width along the axial lengths thereof, and the flexible beams include a base portion having a first width and a tip portion having a second width that is smaller than the first width of the base portion.

2. The electrical connector of claim 1, wherein the base portion of the flexible beams defines a curvature along the first width and the tip portion defines a flat surface along the second width.

3. The electrical connector of claim 1, wherein the body portion is a cylindrical structure having at least seven flexible beams axially extending therefrom.

4. The electrical connector of claim 1, wherein the body portion is a cylindrical structure having a first outer diameter when in the relaxed position and a second outer diameter when in the flexed position.

5. The electrical connector of claim 1, wherein the body portion and the flexible beams are integrally formed from a single sheet of material.

6. The electrical connector of claim 1, wherein the outer surface of the body portion is biased for engagement with the inner surface of the housing.

7. The electrical connector of claim 1, wherein the body portion includes a gap defined between opposing edges thereof that extends along a length of the body portion.

8. The electrical connector of claim 7, wherein the gap defines a first width when the body portion is in a relaxed position and a second width when the body portion is in a flexed position.

9. The electrical connector of claim 1 further including a plurality of support legs that extend outwardly from the body portion.

10. The electrical connector of claim 9, wherein the support legs extend outwardly from an edge of the body portion.

11. The electrical connector of claim 9, wherein the support legs are integrally formed with the body portion from a sheet of material and folded to extend outwardly from the body portion.

12. The electrical connector of claim 9, wherein the body portion is supported on a housing and the support legs are adapted to engage the housing.

13. The electrical connector of claim 1, wherein the housing is made of an electrically conductive material.

14. The electrical connector of claim 13, wherein the flexible beams extend inwardly toward one another such that spaces defined between adjacent flexible beams have a constant width along the axial lengths thereof.

15. The electrical connector of claim 14, wherein the flexible beams include a base portion having a first width and a tip portion having a second width that is smaller than the first width of the base portion.

16. A female type contact for an electrical connector comprising:

a body portion; and a plurality of flexible beams that extend from the body portion, wherein the flexible beams include a base portion having a first width and a tip portion having a second width that is smaller than the first width of the base portion, wherein plural tabs are integrally formed with the body portion and folded to extend along the outer surface of the body portion.

17. The female type contact of claim 16 wherein tabs engage the outer surface of the body portion.

18. The female type contact of claim 16, wherein the body portion is disposed within a housing and an outer surface of the tabs engage an inner surface of the housing.

19. The female type contact of claim 18, wherein the body portion defines a cross section that is adjustable between a relaxed position and a flexed position such that the outer surface of the tabs are biased for engagement with the inner surface of the housing.

20. A female type contact for an electrical connector comprising:

a body portion;

a plurality of flexible beams that extend from the body portion, wherein the flexible beams include a base portion having a first width and a tip portion having a second width that is smaller than the first width of the base portion, wherein the flexible beams extend inwardly toward one another when in a relaxed position such that spaces defined between adjacent flexible beams have a constant width along the axial lengths thereof; and a plurality of support legs that extend outwardly from the body portion;

wherein the body portion is supported on a housing and the support legs are adapted to engage the housing; and wherein the body portion defines a cross section that is adjustable between a relaxed position and a flexed position such that an inner surface of the body portion is biased for engagement with an outer surface of the housing.

* * * * *